US011371528B2

(12) United States Patent
Noble et al.

(10) Patent No.: US 11,371,528 B2
(45) Date of Patent: Jun. 28, 2022

(54) CEILING FAN WITH STOWABLE BLADES AND RELATED METHODS

(71) Applicant: DELTA T, LLC, Lexington, KY (US)

(72) Inventors: Ernest John Noble, Petaling Jaya (MY); Ken Siong Tan, Puchong (MY); Muhammad Yusuf Bin Musa, Kajang (MY)

(73) Assignee: DELTA T, LLC, Lexington, KY (US)

( * ) Notice: Subject to any disclaimer, the term of this patent is extended or adjusted under 35 U.S.C. 154(b) by 103 days.

(21) Appl. No.: 16/735,011

(22) Filed: Jan. 6, 2020

(65) Prior Publication Data

US 2020/0217327 A1 Jul. 9, 2020

Related U.S. Application Data

(60) Provisional application No. 62/788,189, filed on Jan. 4, 2019.

(51) Int. Cl.

| | |
|---|---|
| ***F04D 29/34*** | (2006.01) |
| ***F04D 29/64*** | (2006.01) |
| ***F04D 29/32*** | (2006.01) |
| ***F04D 25/08*** | (2006.01) |

(52) U.S. Cl.

CPC ..... *F04D 29/34* (2013.01); *F04D 25/088* (2013.01); *F04D 29/329* (2013.01); *F04D 29/646* (2013.01)

(58) Field of Classification Search

None

See application file for complete search history.

(56) References Cited

U.S. PATENT DOCUMENTS

| | | | |
|---|---|---|---|
| 1,361,785 | A | 12/1920 | Tucker |
| 1,577,461 | A | 3/1926 | Glasser |
| 1,583,864 | A | 5/1926 | Tucker |
| 4,776,761 | A | 10/1988 | Diaz |
| 5,108,260 | A | 4/1992 | Monrose, III et al. |
| 5,433,585 | A | 7/1995 | Yan |

(Continued)

FOREIGN PATENT DOCUMENTS

| | | | |
|---|---|---|---|
| CN | 201908855 U | * | 7/2011 |
| CN | 201908855 U | | 7/2011 |

(Continued)

OTHER PUBLICATIONS

English Abstract of CN201908855U dated Jul. 27, 2011.

*Primary Examiner* — Juan G Flores

(74) *Attorney, Agent, or Firm* — Dickinson Wright PLLC; Andrew D. Dorisio

(57) ABSTRACT

A ceiling fan includes a hub adapted to be rotated, such as by an onboard motor in a low-profile motor housing. One or more fan blades are adapted to extend radially from the hub. At least one magnet is provided for coupling at least one fan blade to the hub. A hinge may connect the at least one fan blade to the hub, and may be located radially outwardly of overlapping portions of the fan blade and hub. In this manner, the blade may be adapted to extend radially from the hub when deployed and generally vertically when stowed, but in a deployed configuration, the radial extension overlies and contacts at least a portion of the fan blade along an overlapping region, but does not contact the portion of the at least one stowable fan blade when stowed. Related methods are also described.

11 Claims, 8 Drawing Sheets

(56) References Cited

U.S. PATENT DOCUMENTS

| | | | | |
|---|---|---|---|---|
| 6,027,309 | A | 2/2000 | Rawis et al. | |
| 6,155,787 | A | 12/2000 | Hodgkins, Jr. | |
| 6,213,716 | B1 | 4/2001 | Bucher et al. | |
| 6,863,498 | B2 * | 3/2005 | Liang | F04D 29/36 416/142 |
| 8,142,156 | B2 * | 3/2012 | Wiegel | F04D 27/008 416/143 |
| 2004/0151588 | A1 * | 8/2004 | Liang | F04D 25/088 416/142 |
| 2005/0109291 | A1 | 5/2005 | Karanik | |
| 2010/0034651 | A1 * | 2/2010 | Wiegel | F04D 29/384 416/31 |
| 2011/0142655 | A1 | 6/2011 | Chen et al. | |

FOREIGN PATENT DOCUMENTS

| | | | |
|---|---|---|---|
| GB | 2402977 | A | 12/2004 |
| WO | 2020142763 | A1 | 7/2020 |

* cited by examiner

CEILING FAN WITH STOWABLE BLADES AND RELATED METHODS

This application claims the benefit of U.S. Patent Application Ser. No. 62/788,189, filed Jan. 4, 2019, the disclosure of which is incorporated herein by reference.

TECHNICAL FIELD

This document relates generally to electric fans and, more specifically, to a ceiling fan with stowable blades and related methods.

BACKGROUND

Traditionally, a ceiling fan includes a central motor housing with a number of blades extending in fixed radial orientations, which may extend from a few feet to twelve or more feet. It is considered impractical to ship an assembled fan in such a configuration in view of the resulting bulky and cumbersome packaging. Accordingly, a ceiling fan is normally shipped from the factory in pieces, and later assembled by an end user at the point of use. This may involve the shipment of a motor and housing separate from the blades, which are then attached, and sometimes balanced, upon assembly.

Such shipping requires significant amounts of packing material, such as Styrofoam or other packaging components. This increases the expense associated with the packaging of the fan, both in terms of cost of packaging materials, as well as in terms of the worker cost associated with individually packaging separate elements of the ceiling fan and the end-user cost in terms of the final assembly. In addition, the packaging and shipment of a dis-assembled fan may result in an unbalanced final product upon assembly due to the fan being reassembled in a way that results in an imbalance, despite care being taken at the time of manufacture to balance the fan properly.

Furthermore, a fully assembled ceiling fan with blades at fixed lateral positions with respect to the central motor housing is essentially fixed in its operational configuration once it has been installed. This leaves the ceiling fan exposed and at the mercy of the elements (e.g., wind and/or rain), particularly with respect to ceiling fans that may be installed in outdoor locations (which in certain climates may encounter an off-season period of extended non-use). With the blades in the radially extending condition, it is considered impractical to attempt to cover the fan using a single bag or like covering.

Accordingly, a ceiling fan is needed that may be shipped in a fully assembled configuration without the need for bulky and cumbersome packaging, and which in use may be adapted to assume a configuration so as to be protected from the elements. The ceiling fan blades would also be adapted for being deployed in a manner that is easy to achieve, and in a manner that reduces the incidence of noise or rattling.

SUMMARY

According to one aspect of the disclosure, a fan for attachment to a ceiling is provided. The fan comprises a hub adapted to be rotated, and at least one fan blade adapted to extend radially from the hub. At least one magnet is provided for coupling the at least one fan blade to the hub, such as by forming a magnetic coupling (with another magnet or magnetically attractive part).

In some embodiments, the hub comprises a radial extension adapted to attach to the at least one fan blade. The radial extension may overlie at least a portion of the at least one fan blade along an overlapping region, which overlapping region comprises the at least one magnet. The radial extension may overlie and contact at least a portion of the at least one fan blade along an overlapping region in a deployed configuration, but does not contact the portion of the at least one fan blade in a stowed configuration.

In some embodiments, at least one hinge connects the at least one fan blade to the hub. The at least one hinge may be adapted to allow the at least one fan blade to extend radially from the hub when the at least one fan blade is deployed and to extend generally vertically relative to the hub when the at least one fan blade is stowed. The at least one magnet may serve to couple the hub to the at least one fan blade when deployed.

In some embodiments, the fan includes a housing having a height greater than a diameter. The housing may enclose a motor for causing the hub to rotate.

According to a further aspect of the disclosure, a fan for attachment to a ceiling is provided. The fan comprises a hub adapted to be rotated, the hub including at least one radial extension. At least one stowable fan blade is adapted to extend radially from the hub when deployed and generally vertically when stowed. In a deployed configuration, the radial extension overlies and contacts at least a portion of the at least one stowable fan blade along an overlapping region in a deployed configuration, but does not contact the portion of the at least one stowable fan blade in a stowed configuration.

In some embodiments, the at least one stowable fan blade and the radial extension are adapted for forming a magnetic coupling. In some embodiments, a hinge is provided between the at least one stowable fan blade and the radial extension of the hub. In some embodiments, both a hinge and a magnetic coupling are present.

According to a further aspect of the disclosure, a fan is provided for attachment to a ceiling. The fan comprises a hub adapted to be rotated, the hub including at least one radial extension. At least one stowable fan blade is adapted to extend radially from the hub when deployed, such that a first portion of the radial extension at least partially overlaps with a second portion of the least one stowable fan. A hinge connects the at least one stowable fan blade to the hub, and is located radially outwardly of the overlapping first and second portions.

In some embodiments, at least one magnet couples the hub to the at least one fan blade when deployed. The at least one magnet may be attached to the at least one radial extension.

Yet a further aspect of the disclosure pertains to a method of protecting a fan mounted in place and having a plurality of stowable fan blades in a deployed configuration. The method comprises moving the plurality of stowable fan blades to a stowed configuration, wherein the stowable fan blades remain connected to the fan. The method further comprises covering the fan including the plurality of stowable fan blades in the stowed configuration with a covering.

In some embodiments, the method further includes the step of mounting the fan to a ceiling. The method may further comprise covering the fan with the blades in the stowed condition with a bag, which may be removed when the blades are re-deployed.

Still a further aspect of the disclosure pertains to a method of preparing a fan including a plurality of stowable fan blades for delivery to a customer. The method comprises balancing the fan, such as at the point of manufacture or factory. Once the fan is balanced, the method involves placing the plurality of stowable fan blades in a stowed configuration wherein the plurality of stowable fan blades remain connected to the fan. The method further comprises packaging the fan for delivery to the customer with the plurality of stowable blades in the stowed configuration.

In some embodiments, the method further comprises unpackaging the fan, mounting the fan to a ceiling, and moving the plurality of stowable fan blades to a deployed configuration. The blades may at any time be returned to the stowed condition and covered while the fan remains mounted to the ceiling.

BRIEF DESCRIPTION OF THE DRAWING FIGURES

The above and further advantages according to the inventions disclosed herein may be better understood by referring to the following description in conjunction with the accompanying drawings in which.

Figure 1:
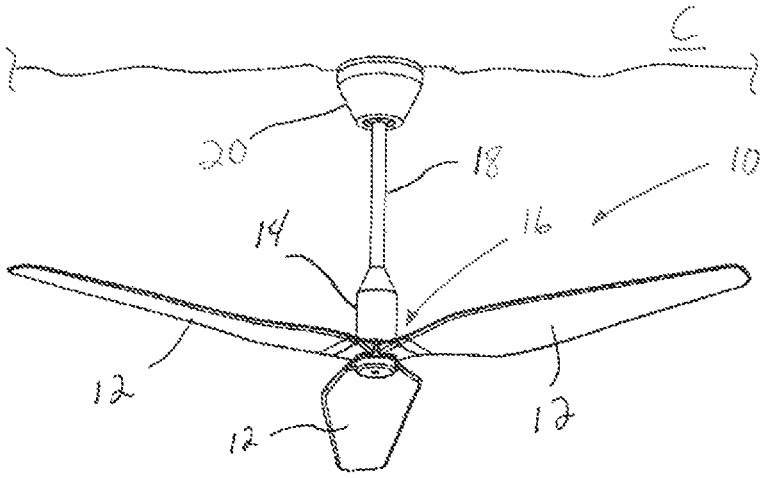
FIG. 1 is a front perspective view of an exemplary fan mounted to a ceiling according to one aspect of the disclosure.

The drawings are not necessarily drawn proportionally or to scale. For example, the dimensions of some of the elements may be exaggerated relative to other elements for clarity or several physical components may be included in one functional block or element. Further, sometimes reference numerals may be repeated among the drawings to indicate corresponding or analogous elements.

DETAILED DESCRIPTION

With reference now to FIG. 1, a fan 10 with one or more blades 12 is provided. As shown, the fan 10 includes a plurality of fan blades 12, which may be associated with a housing 14. The housing 14 may house a motor for causing the blades 12 of the fan 10 to rotate. In particular, the housing 14 may be rotatably connected to a hub 16, which may be adapted to rotate as a result of the connection with the associated motor. The housing 14 may also be connected to an extension 18 adapted for attachment to a ceiling C, such as by way of a mount 20, thus making the fan 10 a "ceiling" fan. Details of various components of ceiling fans that may be used in accordance with the fan 10 of this disclosure, including possible mounting arrangements, may be found in one or more of the following patents, the disclosures of which are incorporated herein by reference: U.S. Pat. Nos. 10,502,216, 9,587,518, 8,900,041, and 8,672,648.

Figure 1A:
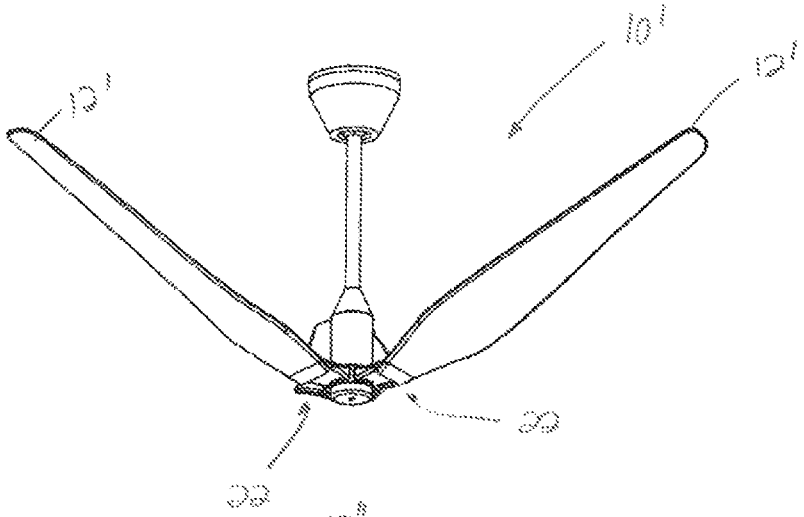
FIG. 1A is a perspective view of the fan of FIG. 1 in a partially stowed configuration.
Figure 1B:
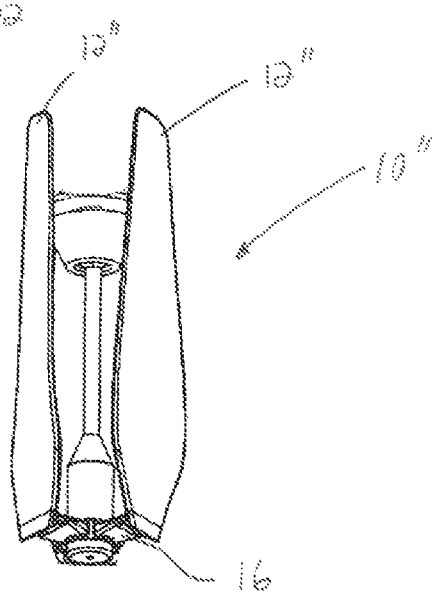
FIG. 1B is a perspective view of the fan of FIG. 1 in a fully stowed configuration.

In accordance with one aspect of the disclosure, the fan 10 may be adapted for transforming between a deployed configuration with the blades 12 radially extending for circulating air when the associated hub 16 is rotated by the motor, and a stowed configuration with the blades extending generally vertically. With reference to FIGS. 1, 1A, and 1B, the fan 10 is shown transitioning between a deployed configuration (10 in FIG. 1), to a partially folded configuration (10' in FIG. 1A) and a stowed configuration (10", FIG. 1B). This may be accomplished by way of one or more hinges 22 associated with one or more of the blades 12 (and may be such that one hinge is provided on each of a plurality of blades). The hinge(s) 22 may be located within the radial extent of the blade 12, such as between first and second portions of it, or may function to attach the blades 12 to the housing 14, such as via the associated hub 16. In the deployed configuration, the blades 12 may extend radially away from the housing 14 (FIG. 1), so that upon rotation, the ceiling fan 10 is adapted to circulate air in the environment in which it is mounted.

As shown in FIG. 1B, in the stowed configuration of the fan 10, the blades (12" in FIG. 1B) may fold to a stowed configuration, with the blade tips in closer proximity to a central vertical axis of the fan 10 than in the deployed configuration. The stowing of the blades 12 may involve folding the blades upward toward the extension 18 and mount 20 (intermediate position of blades 12' in FIG. 1A), which allows for a lower profile of the fan 10 to be achieved. This lower profile may be advantageous in terms of ease of shipment without disassembly, as it provides a more compact design, thereby requiring less material for packaging the fan for shipment. In addition, the ability of the fan to be maneuvered to the stowed condition allows for shipment of the fan 10 in a fully assembled condition.

Shipping the fan 10 in a fully assembled condition also eliminates the need for an end user to assemble the fan for installation, thereby making the installation process easier. In addition, shipping the fan 10 fully assembled allows the fan to be balanced at the factory by professionals familiar with the form, function, and specifications, thereby eliminating potential user error in any installation-site balancing that is often required with traditional ceiling fans. Thus, it is possible for the fan 10 to be tested and properly balanced at the factory (such as by making sure that the blades 12 are balanced in a manner that does not create undesirable or excessive wobble, which can be achieved by substituting blades in and out so that they are closely matched in weight, or by adding or removing weight to one or more of the blades), folded, and shipped in the correctly balanced configuration.

Figure 2:
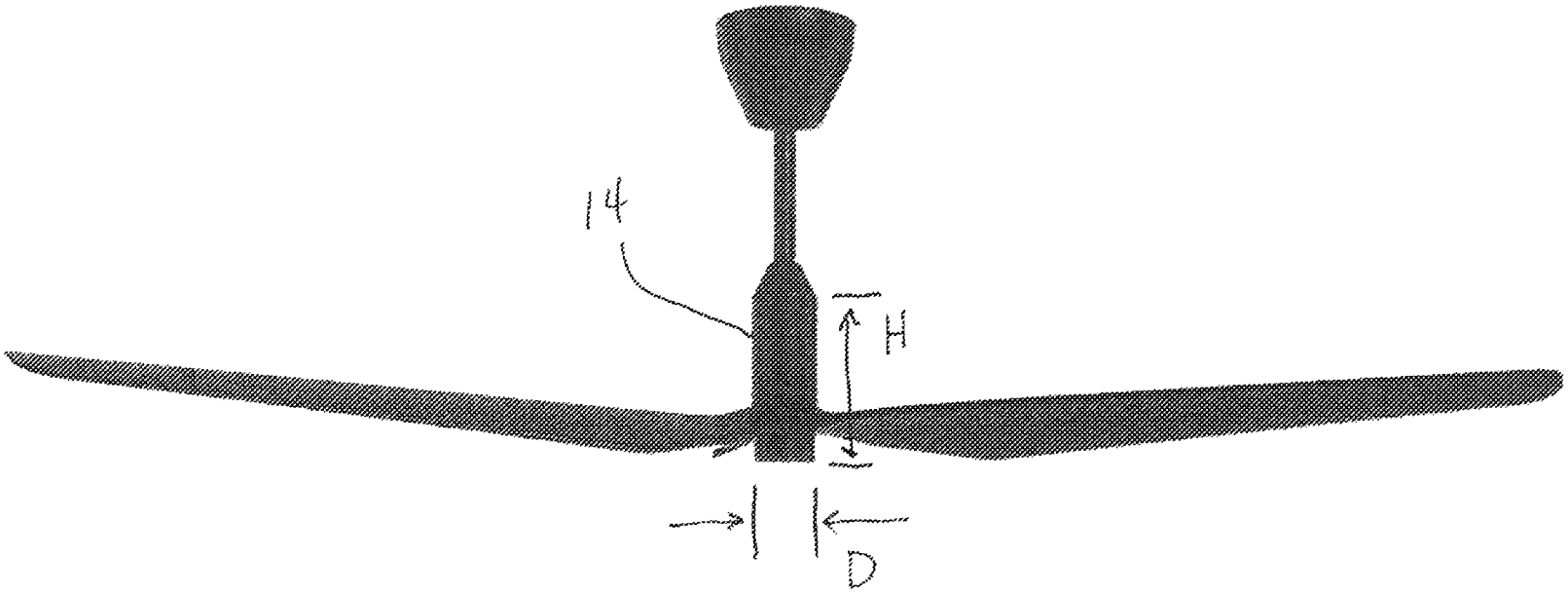
FIG. 2 is a front view of the fan of FIG. 1.

With further reference to FIG. 2, the fan motor housing 14 is illustrated in more detail. As can be seen, the motor housing 14 may have an axially elongated, cylindrical shape, having a diameter D smaller than its height H (and potentially 2-3 times smaller). This low-profile configuration results in a housing 14 that is different from a traditional ceiling fan, which generally a "pancake"-shaped housing having a wider diameter than height. The proposed shape of motor housing 14 may result from a motor that is primarily axially elongated, rather than primarily radially elongated, and enclosed within the housing 14. In the stowed configuration of FIG. 1B, it can be appreciated that this results in a fan 10 with a more compact shape than a traditional fan, which as noted above facilitates the ease of shipment and storage.

Figure 3:
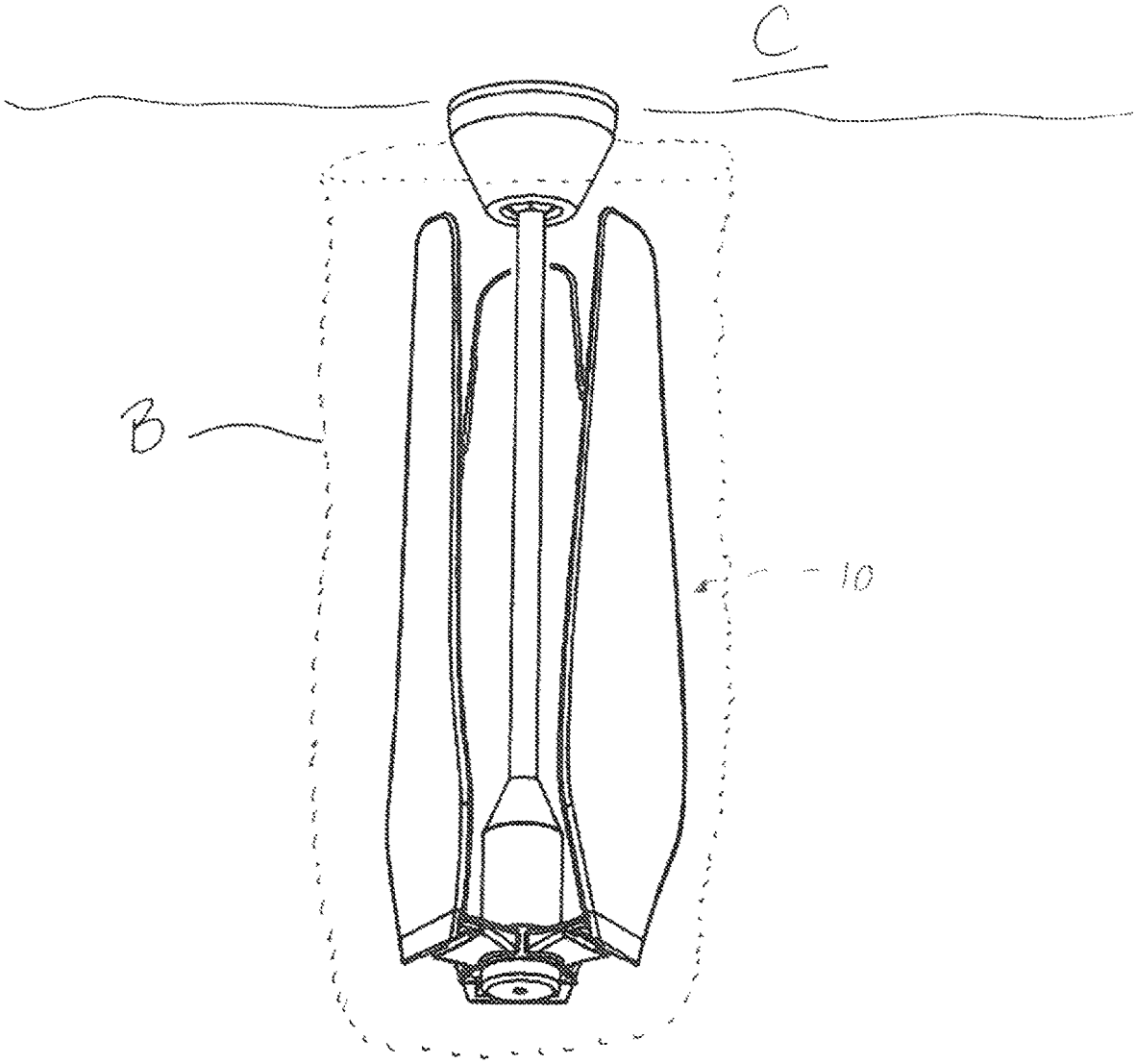
FIG. 3 is a perspective view of the mounted fan of FIG. 1 in a stowed configuration and covered by a covering.

Turning to FIG. 3, a cover, such as for example a sleeve or a bag B may be provided for covering the fan 10 in the stowed configuration. The bag B may be provided upon shipment, and may protect the fan 10 as it is shipped from a factory to a final destination. The bag B may be provided within a box or other shipping container. In one aspect, the fan 10 may be placed within the bag B, and the bagged fan may be placed within a box or other shipping container for shipping.

As can be appreciated, the fan 10 may be placed in the stowed condition both prior to installation (e.g. during shipment), and also subsequent to installation. Accordingly, the bag B may provide protection for the fan both before and after installation. For example, if the fan 10 is installed on a ceiling C in an outdoor environment that may be exposed to the elements and various weather conditions (e.g. dust, dirt, rain, wind, etc.), such as in FIG. 3, then the bag B may shield the fan from such elements. When not in use, the fan 10 may be converted to the stowed condition as illustrated, and the bag B may be placed around and/or secured to the fan such that the bag encloses a portion of or the entirety of the fan. The bag B may be made of any material which may shield the fan from the elements, and may be transparent or opaque. This may be particularly advantageous when the fan may be out of use for an extended period of time, such as when the environment in which the fan is installed is unsuited for normal use (e.g. during winter or off-season). When the fan 10 is ready to be used again, the bag B can be removed, and the fan 10 converted to the operational condition for use by deploying the blade(s) 12.

Figure 4:
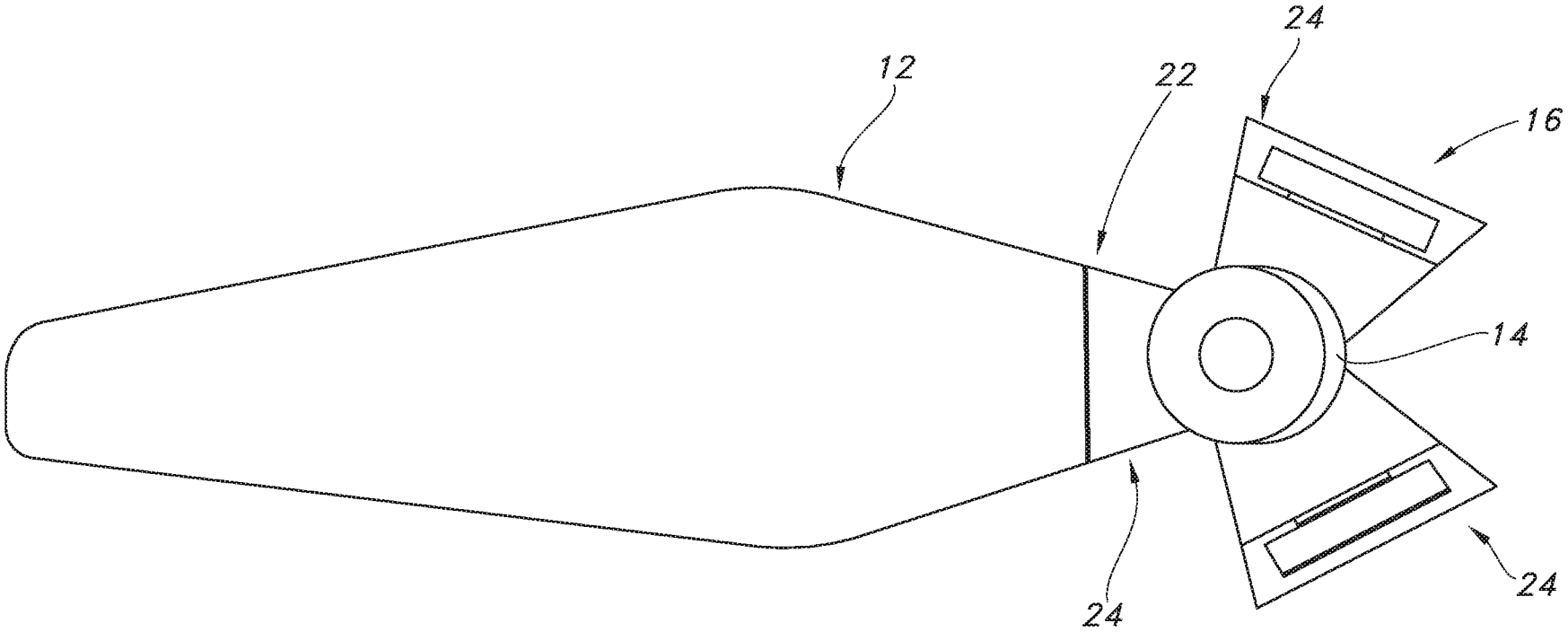
FIG. 4 is a plan view of a single stowable fan blade connected to a hub.
Figure 4A:
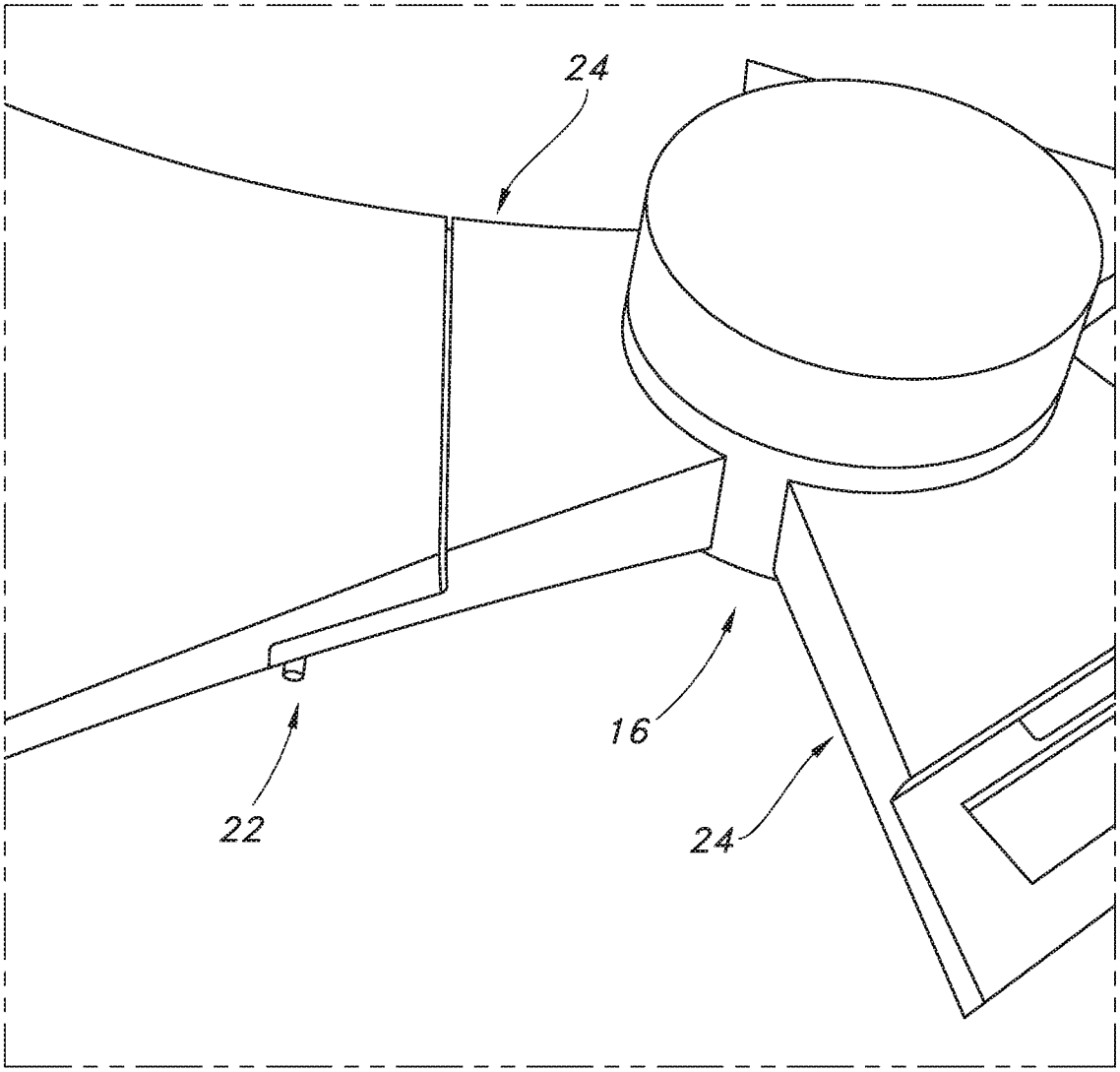
FIG. 4A is an enlarged, bottom perspective view of a single stowable fan blade connected to a hub.
Figure 4B:
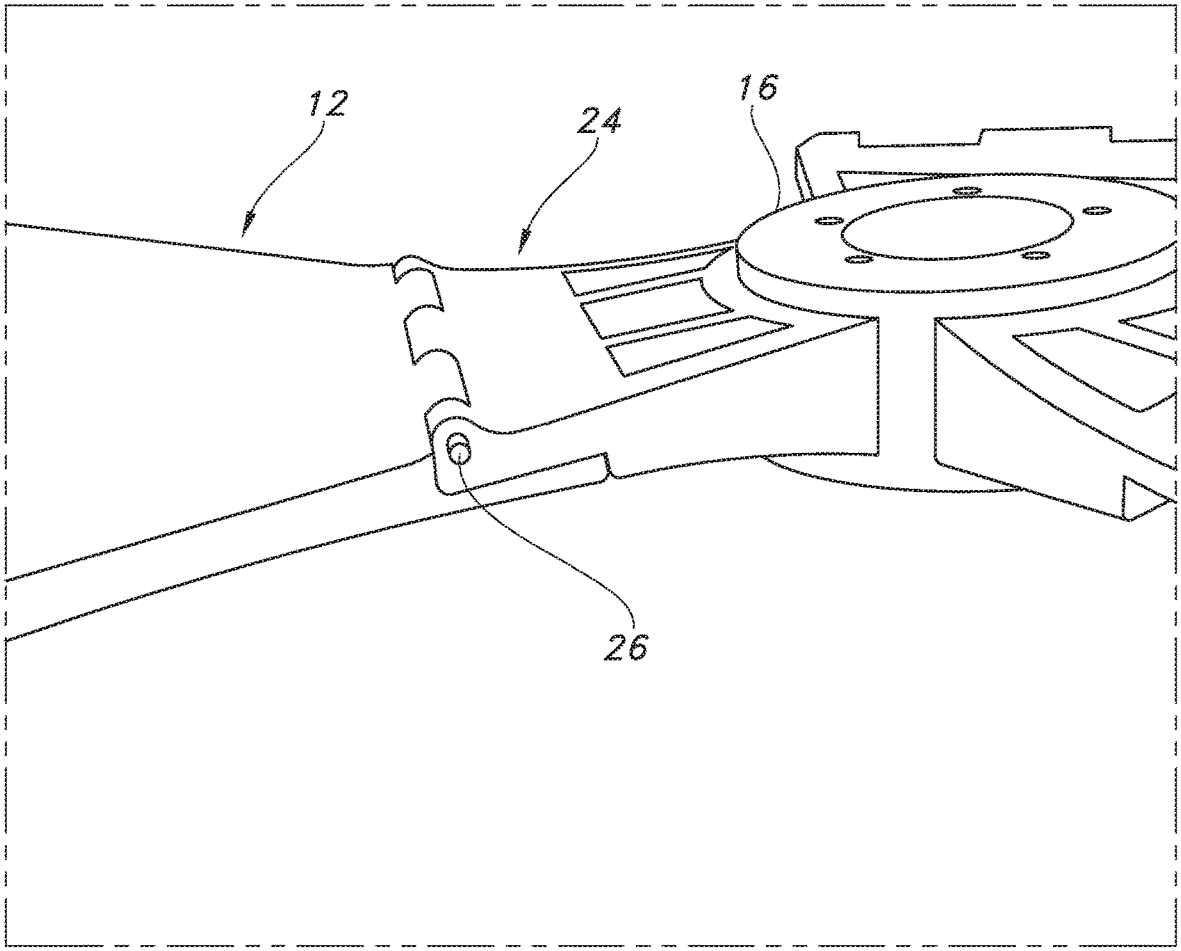
FIG. 4B is an enlarged, top perspective view of a single stowable fan blade connnected to a hub.

As noted above, conversion between the stowed condition and the operational condition may be accomplished by the use of one or more hinges 22 associated with the blades. With reference to FIGS. 4, 4A, and 4B, the blades 12 may be attached to the hub 16 by way of the hinges 22. The hinge 22 may be adapted to connect an extension 24 associated with the hub 16 to a given blade 12, such as by passing a hinge pin 26 transversely through openings formed in interdigitated portions of the corresponding (mated) ends of the blade and the extension.

As illustrated in the bottom view of FIG. 4A, when the fan 10 is viewed from below with the blade 12 deployed, the hinge 22 is not seen by a user. Accordingly, the blade 12 and extension appear to form a visually unitary piece extending from the hub 16. With reference to FIG. 4B, the hinge pin 26 may be visible from a top of the fan in a deployed configuration.

Figure 5:
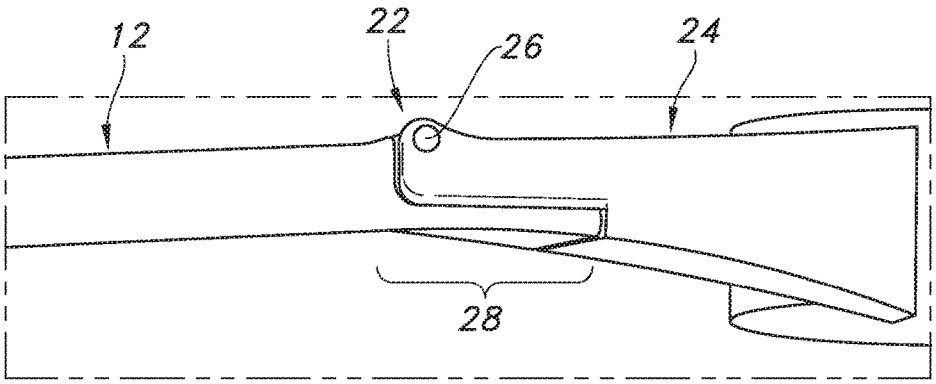
FIG. 5 is a partially cutaway side view of a single stowable fan blade connected to a hub in a deployed configuration.

With further reference to FIG. 5, the blade 12 may have a low-profile when deployed. A lower surface of the extension 24 and a lower surface of the blade 12 may form a substantially continuous profile (save for only a parting line), such that the hinge 22 formed between the two structures is nearly imperceptible from below. In one aspect, the extension 24 and the blade 12 may extend along a common upper plane and lower plane when deployed.

A major plane of the blade 12 may be defined as the plane generally defining a top or bottom surface of the blade in an installed position. Similarly, the extension 24 may include a major plane, which may be defined as the plane generally defining a top or bottom surface of the extension in the installed position. In the operational configuration, the major plane of the blade 12 may align with or be generally parallel to the major plane of the extension 24. In the stowed configuration, the major plane of the blade 12 may be positioned at an angle greater than zero degrees with respect to the major plane of the extension 24. For example, in the stowed configuration, the major plane of the blade 12 may be positioned at approximately 90 degrees with respect to the major plane of the extension 24, and in substantial alignment with the central (rotational) axis of the fan 10.

Figure 5A:
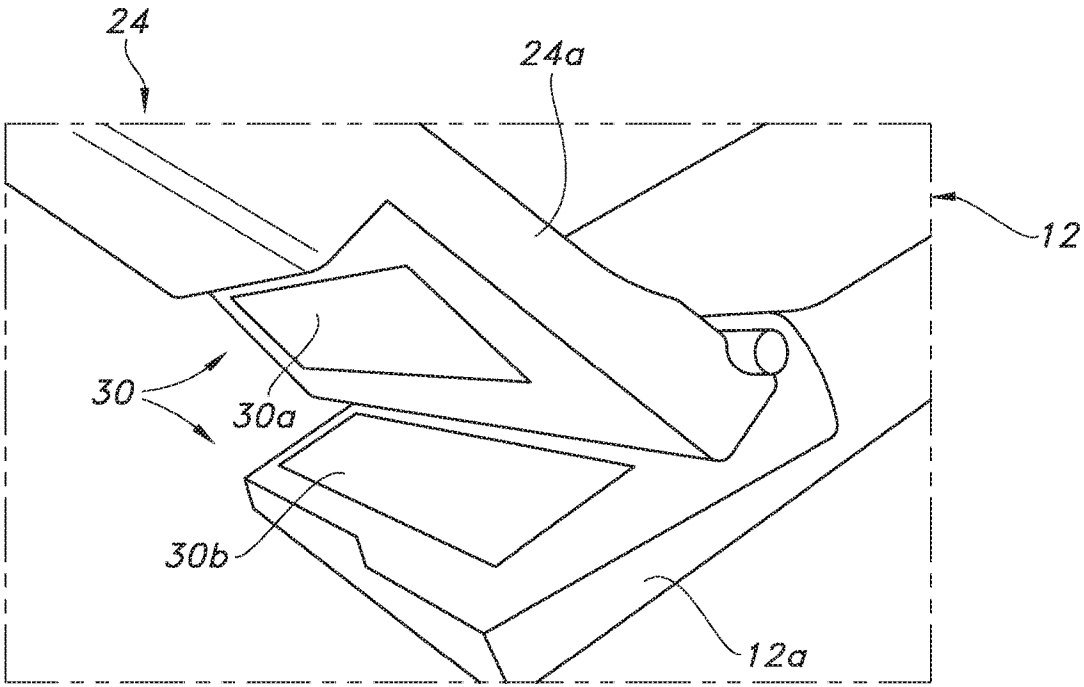
FIG. 5A is a partially cutaway side view of a single stowable fan blade connected to a hub in a partially stowed configuration.

As indicated in FIGS. 5 and 5A, the extension 24 and the blade 12 may at least partially overlap one another along an overlapping region 28 in the operational configuration. The extension 24 may include an extension portion 24*a*, and the blade 12 may include a blade portion 12*a*. In the deployed configuration, the overlapping region 28 may comprise the extension and blade portions 12*a*, 24*a* in an overlapping relationship, and in contact with each other along corresponding surfaces. Thus, a lap joint is formed between the extension and blade portions 12*a*, 24*a* when mated.

The extension portion 24*a* may comprise a first thickness and the blade portion 12*a* may comprise a second thickness. In one embodiment, the combination of the first thickness and the second thickness may be approximately equal to the thickness of the extension 24 radially inward from the overlapping region 28, and also approximately equal to the thickness of the blade 12 radially outward from the overlapping region 28. In the stowed configuration, the corresponding surfaces in contact in the deployed configuration are no longer in contact, as can be understood from FIG. 5A.

Likewise, as can be understood from FIGS. 4 and 4A, the extension portion 24*a* may have a variable width, and the blade portion 12*a* may also have a variable width. At the point where the ends of these portions 12*a*, 24*a* meet, their widths are substantially equal (whether the overall width is variable or not). This provides the appearance of a substantially continuous fan blade 12, especially when viewed from below as shown in FIG. 4A (and potentially also from the side in view of the corresponding thicknesses of each portion 12*a*, 24*a* forming a single thickness of the overall blade 12 from the portion 12*a* to the tip and the remainder of hub 16 distal of extension portion 24*a*).

A radially outward end of the extension 24 may abut a portion of the blade 12, while a radially inward end of the blade 12 may abut a portion of the extension 24. This may result in a generally "stair step" border between the extension 24 and the blade 12 along the overlapping region 28. As illustrated, the extension portion 24*a* may be above the blade portion 12*a*. This overlapped configuration may provide support for the blade 12 in the deployed configuration, as the blade 12 cannot extend beyond an aligned (i.e., 180-degree) configuration with the extension 24. Gravity then holds or retains the blade 12 in the deployed configuration as a result of this overlap.

One or more magnets 30 may be provided to couple the blade 12 with the hub 16 (and extension 24, in particular). For example, the one or more magnets 30 may be provided in association with the overlapping region 28 of the extension 24 and the blade 12. In one aspect, a first magnet 30*a* may be provided in a lower portion of the extension 24. Alternately, the first magnet 30*a* may be provided in an upper portion of the blade 12. In either case, the first magnet 30*a* positioned in one element of the overlapping region 28 may be paired with an attractive (e.g., ferromagnetic) material in the corresponding other portion of the overlapping region. Accordingly, in the case of the stowable blades 12 described above, both gravity and magnetic attraction may maintain the blade in the deployed configuration, and may prevent vibration and rattling during operation. However, the magnetic coupling may be used in other arrangements as well, such as with blades that do not include hinges or which are stowable while remaining attached to the fan 10 (e.g., detachable blades).

In another aspect, the first magnet 30*a* in a first portion of the overlapping region 28 may be paired with a second magnet 30*b* in the corresponding second portion thereof. For example, both the blade portion 12*a* and the extension portion 24*a* may comprise magnets. The first and second magnets 30*a*, 30*b* may be arranged such that the extension 24 and the blade 12 are magnetically coupled as a result of magnetic attraction. Accordingly, in the operational configuration, both gravity and magnetic attraction may maintain the position of the blade 12. This may both ensure optimal operation of the fan 10, and may also prevent vibration and rattling of the blades 12.

The magnet(s) 30 may be neodymium or neo magnets. In one aspect, the magnet(s) 30 may have a north and south pole, and when two magnets are present, arranged in opposition to create the desired magnetic attraction and coupling. The magnets 30 may be mounted with a steel backing plate, and a steel flux return path may be provided. The various components associated with the hinge 22, including the magnets 30 and the hinge pin 26, may be insert molded in the surrounding materials if plastic (e.g., in the case of plastic blades), or may be attached in a corresponding recess of a die cast element (e.g., in the case of a die cast aluminum part). The extension 24 may comprise aluminum, such as for example, die cast aluminum. The blade 12 may be made of any suitable material, such as wood, plastic or metal.

Figure 6:
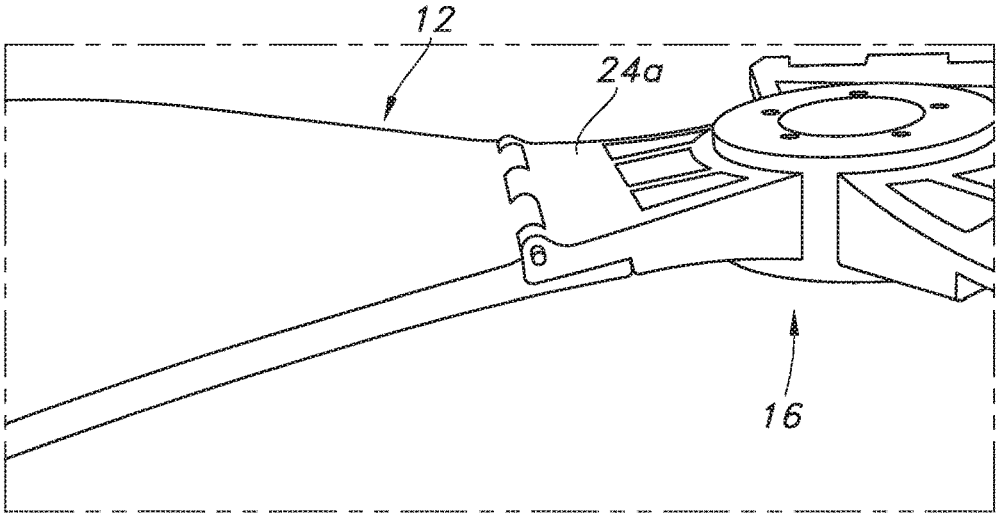
FIGS. 6, 6A, and 6B are enlarged, partially cutaway perspective views illustrating various positions of a single stowable fan blade connected to a hub in a deployed configuration.
Figure 6A:
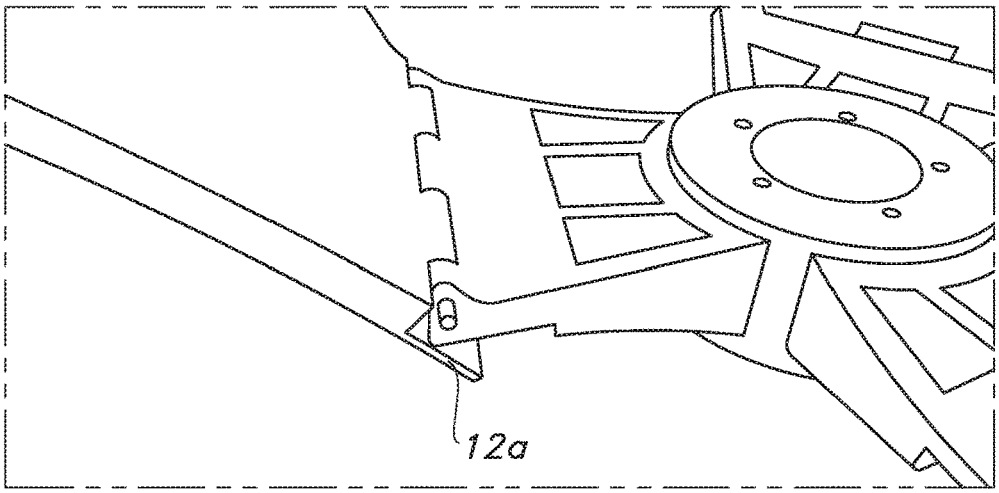
Figure 6B:
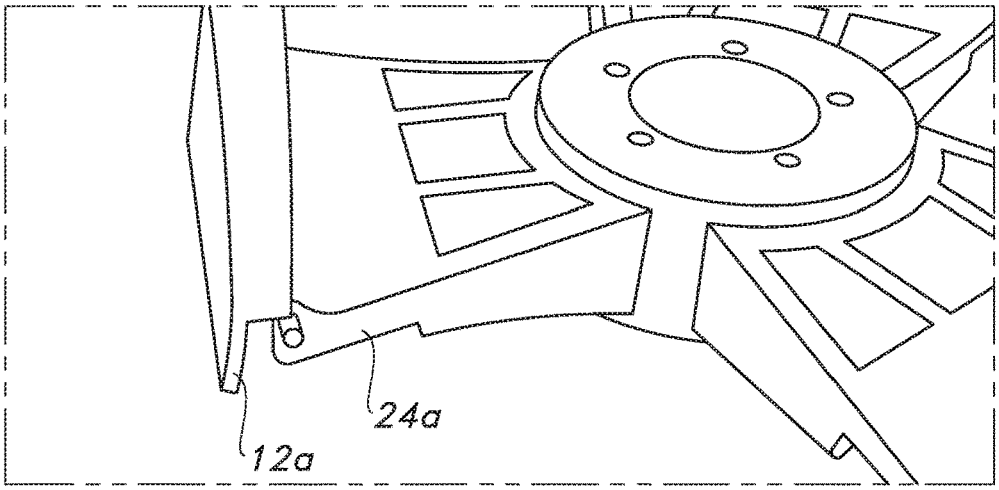

FIGS. 6, 6A and 6B illustrate a further example of the blade 12 rotating from an operational configuration (FIG. 6) to a partially stowed configuration (FIG. 6A), to a stowed configuration (FIG. 6B). As can be seen, the blade 12 may rotate upwardly by way of the hinge 22, with the blade portion 12*a* separating from the extension portion 24*a* and rotating downward, with the remainder of blade 12 including tip rotating upward to a generally vertical position aligned with a central (rotational) axis of the fan 10. Once in the stowed configuration of FIG. 6B, the fan 10 may be bagged, such as for shipment or for storage.

This disclosure may be considered to relate to the following items in any combination:

1. A fan for attachment to a ceiling, comprising:
   a hub adapted to be rotated;
   at least one fan blade adapted to extend radially from the hub; and
   at least one magnet for coupling the at least one fan blade to the hub.
2. The fan of item 1, wherein the hub comprises a radial extension adapted to attach to the at least one fan blade.
3. The fan of item 2, wherein the radial extension overlies at least a portion of the at least one fan blade along an overlapping region, which overlapping region comprises the at least one magnet.
4. The fan of any of items 1-3, wherein at least one hinge connects the at least one fan blade to the hub, the at least one hinge adapted to allow the at least one fan blade to extend radially from the hub when the at least one fan blade is deployed and to extend generally vertically relative to the hub when the at least one fan blade is stowed.
5. The fan of item 4, wherein the at least one magnet couples the hub to the at least one fan blade when deployed.
6. The fan of any of items 2-5, wherein the radial extension overlies and contacts at least a portion of the at least one fan blade along an overlapping region in a deployed configuration, but does not contact the portion of the at least one fan blade in a stowed configuration.
7. The fan of any of items 1-7, further including a housing having a height greater than a diameter.
8. A fan for attachment to a ceiling, comprising:
   a hub adapted to be rotated, the hub including at least one radial extension; and
   at least one stowable fan blade adapted to extend radially from the hub when deployed and generally vertically when stowed, wherein in a deployed configuration, wherein the radial extension overlies and contacts at least a portion of the at least one stowable fan blade along an overlapping region in a deployed configuration, but does not contact the portion of the at least one stowable fan blade in a stowed configuration.
9. The fan according to item 8, wherein the at least one stowable fan blade and the radial extension are adapted for forming a magnetic coupling.
10. The fan according to item 8, further including a hinge between the at least one stowable fan blade and the radial extension of the hub.
11. A fan for attachment to a ceiling, comprising:
    a hub adapted to be rotated, the hub including at least one radial extension;
    at least one stowable fan blade adapted to extend radially from the hub when deployed, such that a first portion of the radial extension at least partially overlaps with a second portion of the least one stowable fan; and
    a hinge connecting the at least one stowable fan blade to the hub, the hinge being located radially outwardly of the overlapping first and second portions.
12. The fan of item 11, wherein at least one magnet couples the hub to the at least one fan blade when deployed.
13. The fan of item 11, wherein the at least one magnet is attached to the at least one radial extension.
14. A method of protecting a fan mounted in place and having a plurality of stowable fan blades in a deployed configuration, comprising:
    moving the plurality of stowable fan blades to a stowed configuration wherein the stowable fan blades remain connected to the fan; and
    covering the fan including the plurality of stowable fan blades in the stowed configuration with a covering.
15. The method of item 14, further including the step of mounting the fan to a ceiling.
16. The method of item 14, wherein the covering comprises a bag.
17. The method of item 14, further including the step of uncovering the fan and moving the plurality of stowable fan blades to the deployed configuration.
18. A method of preparing a fan including a plurality of stowable fan blades for delivery to a customer, comprising:
    balancing the fan;
    once the fan is balanced, placing the plurality of stowable fan blades in a stowed configuration wherein the plurality of stowable fan blades remain connected to the fan; and
    packaging the fan for delivery to the customer with the plurality of stowable blades in the stowed configuration.

19. The method of item 18, further comprising:
unpackaging the fan;
mounting the fan to a ceiling; and
moving the plurality of stowable fan blades to a deployed configuration.

20. The method of item 19, further including the steps of:
moving the plurality of stowable fan blades to the stowed configuration while the fan is mounted to the ceiling; and
covering the fan.

Each of the following terms written in singular grammatical form: "a", "an", and the", as used herein, means "at least one", or "one or more". Use of the phrase "One or more" herein does not alter this intended meaning of "a", "an", or "the". Accordingly, the terms "a", "an", and "the", as used herein, may also refer to, and encompass, a plurality of the stated entity or object, unless otherwise specifically defined or stated herein, or the context clearly dictates otherwise. For example, the phrases: "a unit", "a device", "an assembly", "a mechanism", "a component," "an element", and "a step or procedure", as used herein, may also refer to, and encompass, a plurality of units, a plurality of devices, a plurality of assemblies, a plurality of mechanisms, a plurality of components, a plurality of elements, and, a plurality of steps or procedures, respectively.

Each of the following terms: "includes", "including", "has", "having", "comprises", and "comprising", and, their linguistic/grammatical variants, derivatives, or/and conjugates, as used herein, means "including, but not limited to", and is to be taken as specifying the stated components), feature(s), characteristic(s), parameter(s), integer(s), or step(s), and does not preclude addition of one or more additional component(s), feature(s), characteristic(s), parameter(s), integer(s), step(s), or groups thereof. Each of these terms is considered equivalent in meaning to the phrase "consisting essentially of." Each of the phrases "consisting of" and "consists of, as used herein, means "including and limited to". The phrase "consisting essentially of" means that the stated entity or item (system, system unit, system sub-unit device, assembly, sub-assembly, mechanism, structure, component element or, peripheral equipment utility, accessory, or material, method or process, step or procedure, sub-step or sub-procedure), which is an entirety or part of an exemplary embodiment of the disclosed invention, or/and which is used for implementing an exemplary embodiment of the disclosed invention, may include at least one additional feature or characteristic" being a system unit system sub-unit device, assembly, sub-assembly, mechanism, structure, component or element or, peripheral equipment utility, accessory, or material, step or procedure, sub-step or sub-procedure), but only if each such additional feature or characteristic" does not materially alter the basic novel and inventive characteristics or special technical features, of the claimed item.

The term "method", as used herein, refers to steps, procedures, manners, means, or/and techniques, for accomplishing a given task including, but not limited to, those steps, procedures, manners, means, or/and techniques, either known to, or readily developed from known steps, procedures, manners, means, or/and techniques, by practitioners in the relevant field(s) of the disclosed invention.

Terms of approximation, such as the terms about, substantially, approximately, generally, etc., as used herein, refer to ±10% of a numerical value or as close as possible to a condition.

It is to be fully understood that certain aspects, characteristics, and features, of the invention, which are, for clarity, illustratively described and presented in the context or format of a plurality of separate embodiments, may also be illustratively described and presented in any suitable combination or sub-combination in the context or format of a single embodiment. Conversely, various aspects, characteristics, and features, of the invention which are illustratively described and presented in combination or sub-combination in the context or format of a single embodiment may also be illustratively described and presented in the context or format of a plurality of separate embodiments.

Although the invention has been illustratively described and presented by way of specific exemplary embodiments, and examples thereof, it is evident that many alternatives, modifications, or/and variations, thereof, will be apparent to those skilled in the art. Accordingly, it is intended that all such alternatives, modifications, or/and variations, fall within the spirit of, and are encompassed by, the broad scope of the appended claims.

What is claimed:

1. A fan for attachment to a ceiling, comprising:
a hub adapted to be rotated;
at least one fan blade adapted to extend radially from the hub; and
at least one magnet for coupling the at least one fan blade to the hub;
wherein the hub comprises a radial extension adapted to attach to the at least one fan blade, and wherein the radial extension overlies a portion of the at least one fan blade along an overlapping region, wherein the overlapping region comprises the at least one magnet.

2. The fan of claim 1, wherein the at least one fan blade comprises at least one hinge adapted to allow the at least one fan blade to extend radially from the hub when the at least one fan blade is deployed and to extend generally vertically relative to the hub when the at least one fan blade is stowed.

3. The fan of claim 2, wherein the at least one magnet couples the hub to the at least one fan blade when deployed.

4. The fan of claim 1, wherein the radial extension overlies and contacts the portion of the at least one fan blade along the overlapping region in a deployed configuration, but does not contact the portion of the at least one fan blade in a stowed configuration.

5. The fan of claim 1, further including a motor housing having a height greater than a diameter.

6. A fan for attachment to a ceiling, comprising:
a hub adapted to be rotated, the hub including at least one radial extension; and
at least one stowable fan blade adapted to extend radially from the hub when deployed and generally vertically when stowed, wherein when deployed, the radial extension overlies and contacts a portion of the at least one stowable fan blade along an overlapping region, but does not contact the portion of the at least one stowable fan blade when stowed.

7. The fan of claim 6, wherein the at least one stowable fan blade and the radial extension are adapted for forming a magnetic coupling.

8. The fan of claim 6, further including a hinge between the at least one stowable fan blade and the at least one radial extension of the hub.

9. A fan for attachment to a ceiling, comprising:
a hub adapted to be rotated, the hub including at least one radial extension;
at least one stowable fan blade adapted to extend radially from the hub when deployed, such that a first portion of the radial extension overlaps with a second portion of the least one stowable fan blade; and a hinge connecting the at least one stowable fan blade to the hub, the hinge being located radially outwardly of the overlapping first and second portions.

10. The fan of claim 9, wherein at least one magnet couples the hub to the at least one fan blade when deployed.

11. The fan of claim 10, wherein the at least one magnet is attached to the at least one radial extension.

* * * * *